United States Patent [19]

Surbrook

[11] 4,266,903

[45] May 12, 1981

[54] LIFTING DOLLIE

[75] Inventor: Louis M. Surbrook, Seattle, Wash.

[73] Assignee: Offset Newspaper Equipment Inc., Atlanta, Ga.

[21] Appl. No.: 70,097

[22] Filed: Aug. 27, 1979

[51] Int. Cl.[3] ..... B66C 23/00

[52] U.S. Cl. ..... 414/428; 180/19 R

[58] Field of Search ..... 187/9 R; 414/910, 911, 414/428; 180/19 R, 19 S; 280/263, 270

[56] References Cited

U.S. PATENT DOCUMENTS 2,846,018 8/1958 Puckett ..... 180/19 S 3,301,419 1/1967 Molden et al. ..... 414/428

*Primary Examiner*—Robert J. Spar

*Assistant Examiner*—Kenneth Noland

*Attorney, Agent, or Firm*—Harold L. Marquis

[57] ABSTRACT

A lifting dollie is provided for moving paper rolls, featuring a U shaped frame supported by castor wheels, with a pair of lifting arms which are attached to the ends of a pivot tube extending through a tubular rear frame member with a square cross-section. A hydraulic pump and ram is used to raise the lifting arm. A chain driven steering mechanism is utilized for the remote steering of one of the rear castor wheels.

1 Claim, 4 Drawing Figures

LIFTING DOLLIE

BACKGROUND OF INVENTION

Paper is fed into newspaper printing presses from large rolls of paper into which a paper roll shaft has been inserted, with the ends of the shaft supported by a rollstand. Rolls of paper are presently moved to the rollstand by loading the roll onto a flatbed dollie which is moved into position between each side of the rollstand. It is then necessary to lift the roll into position with lifting levers so it will be supported by the rollstand. This procedure is time consuming as it involves several steps. It is also hazardous to personnel as the rolls are heavy and are not always properly secured during the procedure.

It is an object of this invention to develop a dollie that will lift and transport the roll to the rollstand and then lift it into position. It is a further object to develop a dollie that is only slightly wider than the roll so it can be maneuvered in tight quarters.

Figure 1:
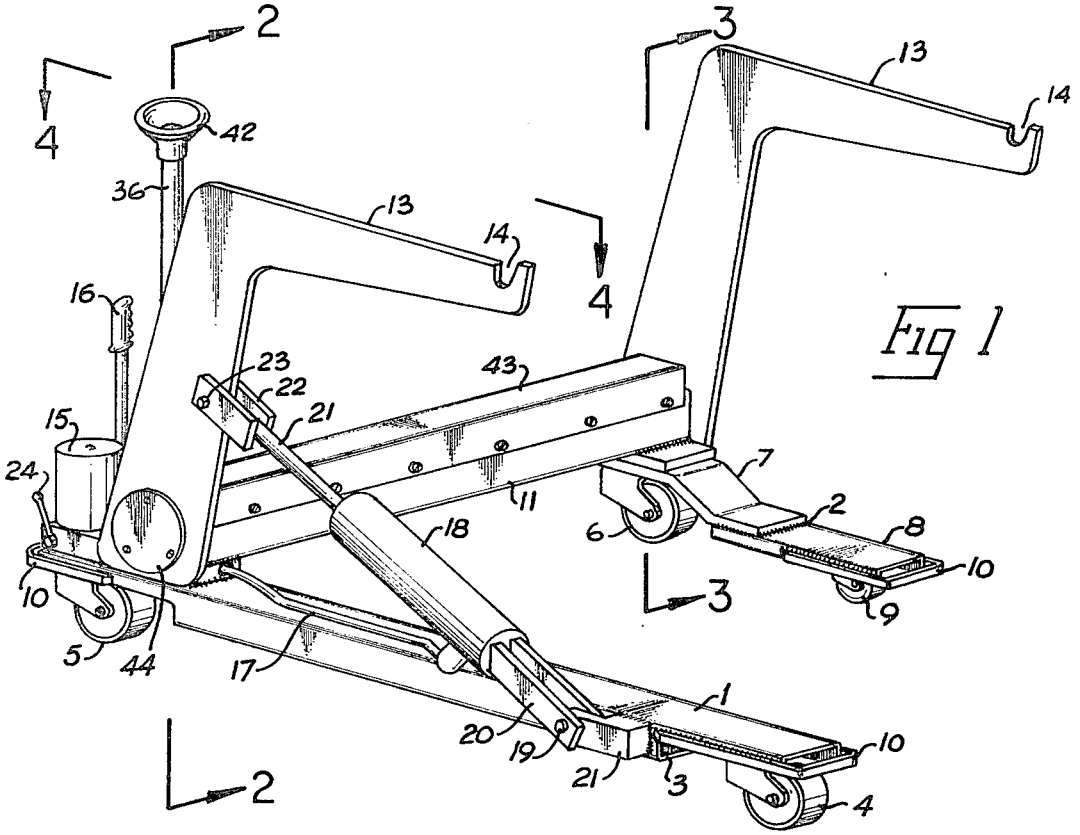
FIG. 1 is a perspective view of the lifting dollie.

Referring more specifically to FIG. 1, the basic lifting dollie includes a frame of a U shaped configuration. The frame comprises parallel side frames 1 and 2. Side frame 1 is preferably formed of steel tubing with side walls and a bottom wall 3 in the center section for reinforcement. Side frame 1 is supported by a front castor wheel 4 and rear castor wheel 5 attached to the front and rear sections respectively of the side frame 1 by conventional means. Side frame 2 is supported at the rear end by a rear castor wheel 6. Preferably side frame 2 can be pivoted about the stem 25 of castor wheel 6 to facilitate maneuvering the dollie in a limited space as it is maneuvered inside the rollstand of the press. Side frame 2 is preferably shorter in length than side frame 1 so that it can be pivoted towards side frame 1 without being obstructed. Side frame 2 is preferably constructed in step form with the frame bent downwardly in a section 7 immediately in front of the back castor wheel 6 and then bent back so it is again parallel to the front in the front section 8 to enable frame 2 to be pivotably positioned below the roll of paper being carried. This step form also provides additional stability to the dollie. The front section 8 is supported by front castor wheel 9, which is smaller in diameter than the other castor wheels. The front and rear of each side frame is preferably protected by a bumper 10.

Figure 2:
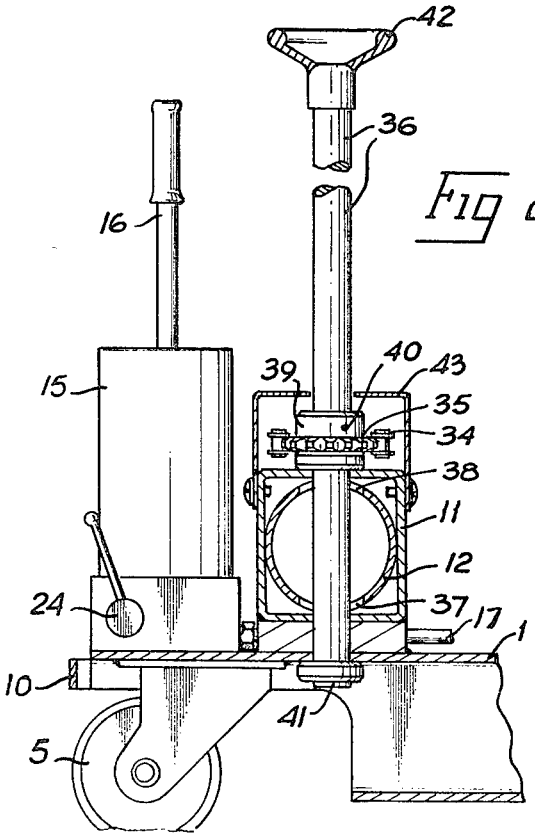
FIG. 2 is a sectional view taken along plane 2—2 of FIG. 1.
Figure 3:
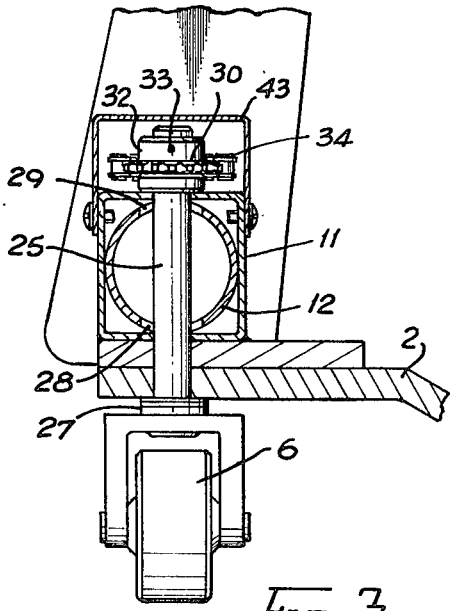
FIG. 3 is a sectional view taken along plane 3—3 of FIG. 1.

The side frames are interconnected by a rear transverse frame 11, which is secured, such as by welds, to the top of rear section of side frame 1 and preferably pivotably connected to side frame 2. The rear frame 11 is constructed of a tubular steel with a square cross-section as illustrated in FIG. 2. A pivot tube 12, as shown in FIG. 2 with a circular cross-section, extends through the interior of the rear transverse frame 11. The outside diameter of the pivot tube 12 is slightly smaller than the inside dimension of the rear transverse frame 11. In lieu of the pivot tube 12, a solid pivot shaft can be used if necessary to support the roll carried by the lifting dollie.

Each end of the pivot tube 12 extends slightly beyond the respective end of the transverse rear frame 11 and is secured to a lifting arm 13, such as by a weld, which extends upward for a sufficient distance so the roll can be carried off the floor and then extends towards the front of the dollie so the roll will be properly balanced over the center of the dollie. The lifting arm 13 as shown in FIG. 1 is in the carrying position. Alternatively, the lifting arm could be constructed without a bend and attached so it extends upward and forward at approximately 45 degree angle with side frames 1 and 2 when the arm is in the carrying position. Each lifting arm has a notch 14 in which the paper roll shaft supporting the roll rests.

Figure 4:
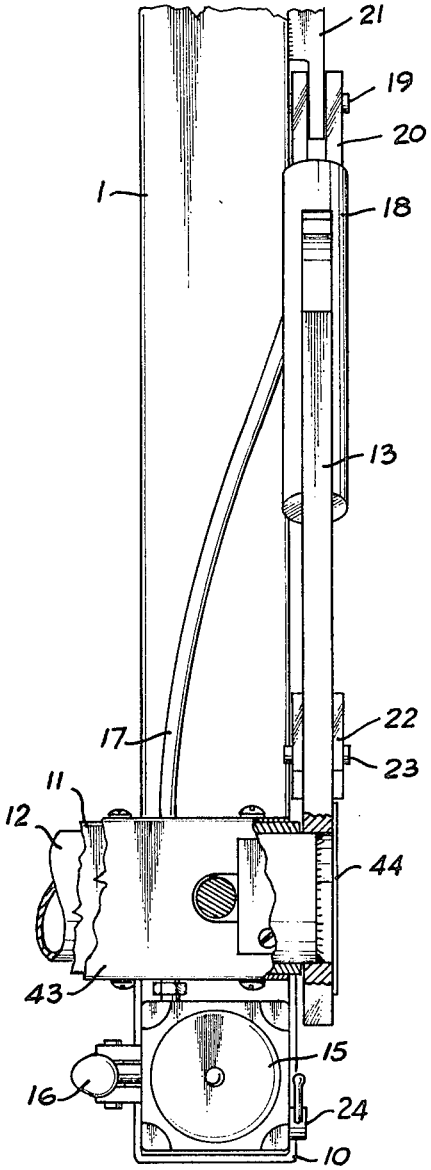
FIG. 4 is a sectional view taken along plane 4—4 of FIG. 1.

A conventional hydraulic pump 15 is attached to the top of the rear section of side frame 1. The pump has a lever 16 for pumping hydraulic fluid, under pressure, from the reservoir in the pump through a hydraulic line 17 to a conventional hydraulic ram 18, which is pivotably mounted to the side of the side frame 1 underneath the lifting arm 13 by a bolt or pin 19 extending through apertures in a clevis 20 attached to the ram 18 and an aperture in mounting bracket 21 attached to the frame. The ram 18 has a vertical movable shaft 21, which, as shown in FIG. 4, has a clevis 22 attached at its upper end. A pin or bolt 23 extends through the apertures in the clevis 22 and an aperture in the arm. Although not essential for most lifting operations, a second ram could be attached to the other lifting arm. The pump 15 has a release valve 24 for releasing the fluid in the hydraulic ram 18 back into the reservoir of the pump to lower the lifting arms 13. Alternatively, a hydraulic or mechanical jack could be substituted for the hydraulic ram 18, in which case the hydraulic pump 15 would not be needed.

The lifting dollie may also be equipped with a mechanism to steer the rear castor wheel 6 on side frame 2 from a remote location near side frame 1. This permits the operator to maneuver the dollie in tight spaces. The stem 25 of castor 6 extends upwardly through a bearing collar 27 and an aperture in the side frame 2 and rear frame 11 and through slots 28 and 29 cut into the top and bottom of the pivot tube 12 and aperture in the top of the rear frame. The slots 28 and 29 are cut through sufficient sections of the circumference of the pivot tube 12 so the tube can pivot to the degree desired to lift and lower the lifting arms. A co-axial sprocket wheel 30 is secured to the upper end of the stem 25 and is held in proper vertical position by a hub 32 and set screw 33. A drive chain 34 extends around co-axial sprocket wheel 30 and extends parallel along the top of the rear support 11 and around a co-axial sprocket wheel 35 attached to the steering rod 36, which is perpendicular to the rear frame 11. The steering rod similarly extends through an aperture in the top and bottom walls of the rear support 11 and slots 37 and 38 FIG. 2 in the pivot tube 12 and through an aperture in the top of side frame 1. Co-axial sprocket wheel 35 is vertically supported by a hub 39 and set screw 40. The steering rod has a bearing collar 41 immediately beneath the bottom of the side frame 1 so that the rod can be freely turned. A hand wheel 42 is attached to the top end of the steering rod 36. A removable protective cover 43 may be attached to the rear frame 11 to protect the chain and sprocket wheels. The steering rod 36 extends through an aperture in the top of the cover 43. Alternatively, the co-axial sprocket wheels 30 and 35 can be located on the inside of the pivot tube 12. In this alternative mode, access to the sprocket wheels and chain 34 can be obtained through cover plate 44.

In moving a roll of paper, the lifting arms 13 can be lowered by releasing fluid from the hydraulic ram 18 by opening release valve 24. The lifting dollie is then maneuvered so that the side frames 1 and 2 are moved along the ends of a roll so that the ends of the paper roll shaft rests in notches 14. The release valve 24 is then closed and by reciprocating movement of the pump handle 16, the shaft 21 is extended, which lifts the roll into a transporting position. Side frame 2 can then be pivotably moved inward so that castor wheel 9 is positioned directly beneath the paper roll to allow sufficient clearance as the dollie is moved into position inside the rollstand. A stop can be attached to the transverse frame 11 to limit the inward movement of side frame 2. Outward pivoting movement of frame 2 is limited by the lower portion of arm 13 whether in raised or lowered position. The lifting dollie is then pushed to the rollstand of the press and the roll lowered so that paper roll shaft is properly engaged in the rollstand. Maneuverability of the lifting dollie in tight places is facilitated by the steering mechanism.

Although the lifting dollie is designed to lift and transport rolls of paper, it can be used to carry rolls of wire, or other material, in a similar fashion.

What i claim is:

1. A dollie for lifting and transporting articles comprising:

(a) two side frames spaced apart with each frame having a front and rear end and at least one wheel supporting each end of the frame, in which the wheel supporting the rear end of one side of the frame is a castor wheel, rotatably attached to the frame by a stem to which a co-axial sprocket wheel is fixedly attached with a drive chain extending around the wheel and a corresponding sprocket wheel fixedly attached to a steering shaft rotatably attached to the rear end of the other side frame so that the castor wheel can be steered from a remote location near the other side frame;

(b) a tubular transverse frame interconnecting the rear end of each side frame, with the transverse frame having an open end adjacent to each side frame;

(c) a pivot member with a circular and tubular cross-section extending through the transverse frame with an end extending beyond each of the open ends of the transverse frame, with the stem of the castor wheel extending through slots in the pivot member;

(d) a pair of lifting arms with each arm rigidly attached to an end of the pivot member and the pair of arms extending toward the front ends of the side frames; and (e) lifting means for raising and lowering the lifting arms.

* * * * *